US011640826B2

(12) United States Patent
Yarman

(10) Patent No.: US 11,640,826 B2
(45) Date of Patent: May 2, 2023

(54) REAL TIME DIGITAL VOICE COMMUNICATION METHOD

(71) Applicant: RFT ARASTIRMA SANAYI VE TICARET ANONIM SIRKETI, Istanbul (TR)

(72) Inventor: Bekir Siddik Binboga Yarman, Istanbul (TR)

( * ) Notice: Subject to any disclaimer, the term of this patent is extended or adjusted under 35 U.S.C. 154(b) by 513 days.

(21) Appl. No.: 16/960,145

(22) PCT Filed: Jan. 25, 2019

(86) PCT No.: PCT/TR2019/050051
§ 371 (c)(1),
(2) Date: Jul. 6, 2020

(87) PCT Pub. No.: WO2019/199262
PCT Pub. Date: Oct. 17, 2019

(65) Prior Publication Data

US 2021/0074304 A1 Mar. 11, 2021

(30) Foreign Application Priority Data

Apr. 12, 2018 (TR) ..... 2018/05188

(51) Int. Cl.
*G10L 19/02* (2013.01)
*G10L 19/00* (2013.01)
*G10L 19/002* (2013.01)

(52) U.S. Cl.
CPC ..... *G10L 19/02* (2013.01); *G10L 19/002* (2013.01); *G10L 19/0018* (2013.01); *G10L 2019/0001* (2013.01)

(58) Field of Classification Search
CPC ..... G10L 19/02; G10L 19/18; G10L 19/002; G10L 2019/0001
See application file for complete search history.

(56) References Cited

U.S. PATENT DOCUMENTS 5,509,031 A * 4/1996 Johnson ..... H03M 13/00 375/296
9,774,745 B2 * 9/2017 Feuer ..... H04L 51/56
(Continued)

FOREIGN PATENT DOCUMENTS

CN 103915097 A 7/2014
JP H04373333 A 12/1992

OTHER PUBLICATIONS

SYMPES technique encoded IP-based secure voice communication system (Yarman B Siddik; Ulger Cem; Aslan A Burak); 2017 International Symposium on Signals, Circuits and Systems (ISSCS), IEEE, Jul. 13, 2017 (Jul. 13, 2017) doi:10.1109/ISSCS .2017. 8034870, 17174802 INSPEC E20174404324615 (Year: 2017).*
(Continued)

*Primary Examiner* — Anne L Thomas-Homescu
(74) *Attorney, Agent, or Firm* — Egbert, McDaniel & Swartz, PLLC

(57) ABSTRACT

A communication system includes at least one first device and at least one second device which are linked in a manner that enables data transfer with each other. The first device enables the speech signal that it receives as the input to be expressed in terms of the energy functions representing the energy patterns, information functions representing the information patterns and the noise functions of the frames of the real speech samples; and transfers the indexes of these functions in the database and the frame gain factor of each frame to the second device. The second device finds the functions via the indexes from the copy database which is a copy of the database and reconstructs the speech signal by these functions and the frame gain factor, enabling it to be provided as the voice output.

4 Claims, 1 Drawing Sheet

(56) References Cited

U.S. PATENT DOCUMENTS

| | | | | |
|---|---|---|---|---|
| 2004/0193407 | A1* | 9/2004 | Ramabadran | G10L 25/90 704/207 |
| 2005/0228648 | A1* | 10/2005 | Heikkinen | G10L 19/20 704/205 |
| 2009/0070119 | A1* | 3/2009 | Yoo | G10L 19/16 704/500 |
| 2010/0121648 | A1* | 5/2010 | Zhang | G10L 19/025 704/E21.001 |

OTHER PUBLICATIONS

A New Method to Represent Speech Signals Via Predefined Signature and Envelope Sequences (Umit Guz, Hakan Gurkan, Binboga S1dd1k Yarman); EURASIP Journal on Advances in Signal Processing, vol. 2007,Dec. 1, 2006 (Dec. 1, 2006) doi: 10.l 155/2007/56382 (Year: 2006).*

Simplified sympes codec with positive DC offset (Yarman BS; Korkrnaz 0; TemizyurekM; InceF; Hassoy B; Canberi H; Ceren E; GultekinE) 2017 24th IEEE International Conference on Electronics, Circuits and Systems (ICECS), IEEE, doi:10.1109/ICECS .2017.8292054 Dec. 5, 2017 (Year: 2017).*

A new algorithm for high speed speech and audio coding (Umit Guz; Hakan Gurkan; Siddik Yarman B); Circuit Theory and Design, 2007. ECCTD 2007. 18th European Conference, IEEE, Piscataway, NJ, USA | 0013670 In Spec, ISBN 978-1-4244-134 l-6 ; ISBN l-4244-1341-9, pp. 180-183 Aug. 27, 2007 (Year: 2007).*

Siddik et al., "SYMPES technique encoded IP-based secure voice communication system", 2017 International Symposium on Signals, Circuits and Systems (ISSCS), IEEE, Jul. 13, 2017.

Guz et al., "A New Method to Represent Speech Signals Via Predefined Signature and Envelope Sequences", Hindawi Publishing Corporation, EURASIP Journal on Advances in Signal Processing, vol. 2007, Dec. 1, 2006.

Korkmaz et al., "Simplified sympes codec with positive DC offset", 2017 24th IEEE International Conference on Electronics, Circuits and Systems (ICECS), IEEE, pp. 202-205, Dec. 2017.

Guz et al., "A new algorithm for high speed speech and audio coding", Circuit Theory and Design, 2007. ECCTD 2007. 18th European Conference, IEEE, Piscataway, NJ, USA, pp. 180-183, Aug. 27, 2007.

International Search Report for corresponding PCT/TR2019/050051.

Written Opinion of the ISA for corresponding PCT/TR2019/050051.

* cited by examiner

REAL TIME DIGITAL VOICE COMMUNICATION METHOD

FIELD OF THE INVENTION

The present invention relates to communication systems comprising at least one first device and at least one second device which are linked in a manner that enables data transfer with each other.

BACKGROUND OF THE INVENTION

Transfer and storage of speech signals has become widespread in modern communication systems.

The application no. U.S. Pat. No. 5,509,031 discloses a system wherein encoded speech signals are transmitted via radio waves. The application no. U.S. Pat. No. 9,774,745 discloses a system which enables to transmit voice data between devices connected to IP network and devices connected to PSTN. The application no. JPH04373333 discloses a method which reduces the effect of the data loss caused by a transmission error.

The speech compression area aims to reduce the bandwidth of the data transfer or to reduce the area where the data is stored while maintaining the quality of the audio output. In the current art; algorithms based on numerical, mathematical, statistical and heuristic methodologies are used to represent or compress the speech signal. The FULL RATE technique and ADPCM (Adaptive Differential Pulse Code Modulation) technique are used to construct the speech signals. FULL RATE uses the bit rate of 13.2 kbps with acceptable hearing quality. ADPCM offers a higher hearing quality compared to FULL RATE but requires higher bit rates (16-32 kpbs).

There is a need for systems wherein the speech signals are sent or stored using less bandwidth and in doing so, maintaining high quality of hearing. Furthermore, in systems that transmit speech signal by encryption, there is also a need for systems that provide a more secure speech signal transmission, as the confidentiality of the signal transmission is compromised in the event that the cypher decoder is intercepted or hacked.

The article titled "A New Method to Represent Speech Signals via Predefined Signature and Envelope Sequences (EURASIP Journal on Advances in Signal Processing, Vol: 2007, Article number: 56382, page 17, authors: Umit Guz, Hakan Gurkan and Binboga Siddik Yarman)" describes representation of speech signals in terms of energy and information functions.

As a result, all of the above-mentioned problems have made it necessary to make an innovation in the related technical field.

SUMMARY OF THE INVENTION

The present invention relates to a voice communication system developed to eliminate the abovementioned disadvantages and bring new advantages to the concerned technical field.

It is an object of the invention to provide a voice communication system which consumes less bandwidth than the systems in the state of the art, and when doing so, maintains the hearing quality.

Another object of the invention is to enable storage of the speech data by occupying less space.

A further object of the invention is to provide a voice communication system and method with enhanced security.

Another object of the invention is to provide a voice communication system and method wherein the noise in the speech data is reduced.

The present invention is a voice communication method for a communication system comprising at least one first device and at least one second device linked in a manner that enables data transfer with each other, in order to achieve all the objects which are mentioned above, and which will become apparent with the detailed description given below. Accordingly, the innovation of the invention is that it comprises the steps performed by the first device, wherein the steps are; receiving a speech signal as the input, dividing the said speech signal into frames, accessing a first database comprising multiple energy functions that are different from each other, each of which represents the energy patterns of the frames of multiple sample speech signals; a second database comprising multiple information functions, each of which represents at least the information signal and/or carrier signal of the frames of multiple sample speech signals; and a third database comprising noise functions, each of which represents the difference between the initial states of the frames of the multiple sample speech signals and their multiple reconstructed states obtained by using at least one information function and at least one energy function pertaining to these frames; selecting one energy function and one information function for the frames from the said first database and the said second database, obtaining a reconstructed frame for each frame by using the selected energy function and the information functions and the frame gain factor (C), subtracting the associated reconstructed frame from each frame and selecting one noise function from the third database that expresses the obtained difference, sending the indexes of the energy, information and noise functions selected for each frame and the frame gain factor (C) to the second device; and the steps performed by the second device (200), wherein the steps are receiving the indexes of the energy, information and noise functions related to the frames and the frame gain factor (C), accessing one copy of each of the first database, second database and third database, and selecting energy, information and noise functions related to the indexes for each frame, obtaining a reconstructed frame from the selected energy and information function, constructing a new frame by adding the associated noise function to each reconstructed frame. Thus, the speech data is only carried by the indexes thereby allowing less bandwidth to be used during transmission. Furthermore, since the data can be stored as indexes, the space required to store the data is also reduced. In addition, the security of the communication is high since any ill-intentioned third parties who want to decode the communication must have the entire database in their possession.

The feature of a preferred embodiment of the invention is to have the following step after the step of "constructing a new frame by adding the associated noise function to each reconstructed frame", constructing a new speech signal by merging sequential new frames.

The invention is also a voice communication system comprising a first device having a processing unit that exchanges data via a first communication interface, and a second device having a second communication interface arranged to provide data exchange with the said first device, and a second processing unit receiving data from the said communication interface or transmitting data to the communication interface. Accordingly the innovation is that the first processing unit is configured to receive a speech signal as the input, divide the said speech signal into frames, access a first database comprising multiple energy functions that are different from each other, each of which represents the energy patterns of the frames of multiple sample speech signals; a second database comprising multiple information functions, each of which represents at least the information signal and/or carrier signal of the frames of multiple sample speech signals; and a third database comprising noise functions, each of which represent the difference between the initial states of the frames of the multiple sample speech signals and their reconstructed states obtained by using at least one information function and at least one energy function pertaining to these frames; select one energy function and one information function for the frames from the said first database and the said second database, obtain a reconstructed frame for each frame by using the selected energy function and the information function and the C gain factor, subtract the associated reconstructed frame from each frame and select one noise function from the third database that represent the obtained difference, send the indexes of the energy, information and noise functions selected for each frame and the C gain factor to the second device; and that the second processing unit is configured to receive the indexes of the energy, information and noise functions of the frames as input; access one copy of each of the first database, second database and third database, and select energy, information and noise functions associated with the indexes for each frame; obtain a reconstructed frame from the selected energy, information function and frame gain factor; construct a new frame by adding the associated noise function to each reconstructed frame.

The feature of another embodiment of the invention is that the second processing unit is configured to enable voice output through an input/output unit by using the new frames.

DETAILED DESCRIPTION OF THE INVENTION

In this detailed description, the present invention is described with examples that are provided only to facilitate better understanding of the invention without producing any limiting effect.

The voice communication system of the present invention is basically operated with the principle of a first device (100) representing the received speech with the functions in the databases preconstructed from speech samples, sending the indexes of these functions to a second device (200), the second device (200) using these indexes to find the concerned functions in a database that is a copy of the said database and constructing the speech again with these functions. Thus, instead of directly transferring the speech data, the bandwidth used for the voice communication is substantially reduced by sequentially sending the indexes of the functions by which the speech is represented.

Another innovative aspect of the present invention is that the noise caused by the representation of speech by functions is also substantially reduced. This reduction is achieved by taking into account the differences between the sampled speech and the speech reconstructed upon reconversion of the functions, when the sampled speech segments are represented by the functions.

Figure 1:
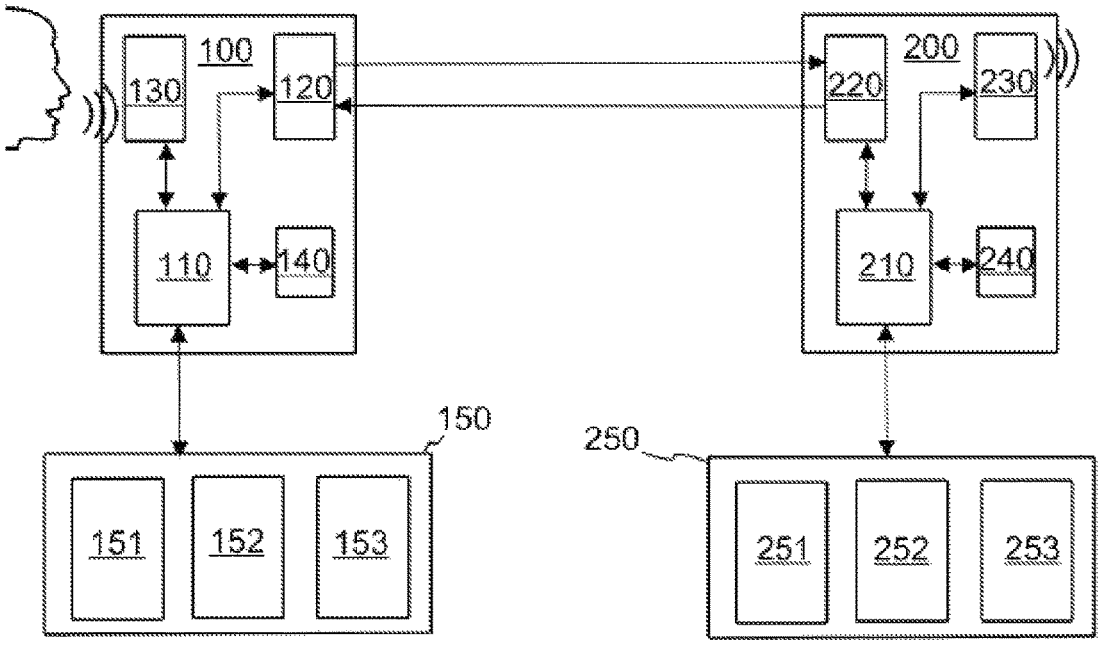
FIG. 1 is a schematic view of the voice communication system.

In a possible embodiment given in FIG. 1, the voice communication system comprises at least one first device (100) and at least one second device (200). The first device (100) is arranged to access a database (150). The second device (200) is arranged to access a copy database (250) which is a copy of the said database (150).

The database (150) includes a first database (151), a second database (152), and a third database (153). The said databases can be provided in separate data storage units as well as in a single data storage unit.

Figure 2:
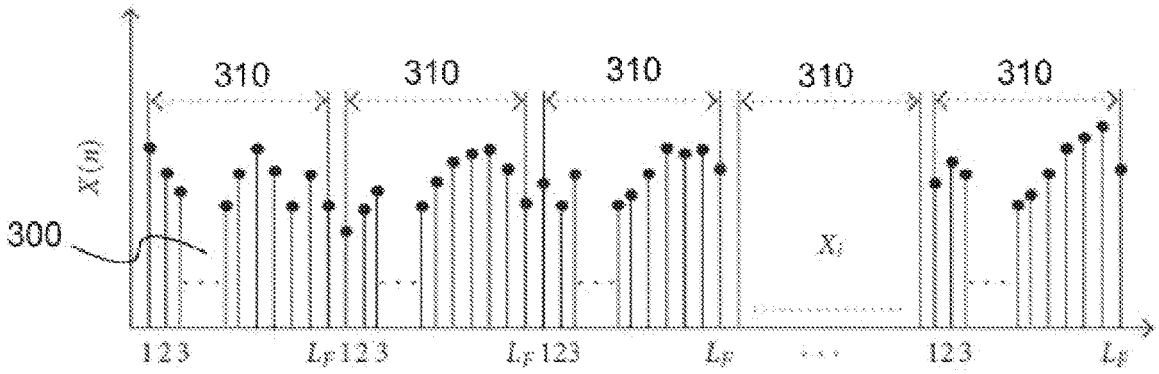
FIG. 2 is a representative view of the speech signal and frames.

The first database (151) is formed as follows: Multiple speech samples are collected. These speech samples may be speech in different languages, speech recorded by speakers having different tones and features of voice, music sounds and etc. In this example embodiment, the speech samples are recorded as 8000 khz, 8 bit PCM format in the form of a way file. The speech signals (300) are first formed into arrays and these arrays are formed into frames (310) with a certain sampling frequency. FIG. 2 shows a representative view of the speech signal (300) and the frames (310) formed of the samples.

When constructing the second database (152), each frame (310) is expressed in terms of an energy function, a frame gain factor and an information function. The energy function represents the energy patterns of the frames (310) of the sample speech signal (300). The information function represents at least the information signal and/or the carrier signal of the frames of the speech signal. The acquisition of these functions is described in detail in the article by Binboga which is cited in the "background of invention" section.[1]

[1]A New Method to Represent Speech Signals Via Predefined Signature and Envelope Sequences (EURASIP journal on advances in signal processing, Vol: 2007, Article No: 56382, page 17, authors: Umit Guz, Hakan Gurkan and Binboga Siddik Yarman The energy functions which have the same pattern or sufficiently close patterns are eliminated and the energy functions which are different from each other are stored in the first database (151). Similarly, the information functions which have the same pattern or sufficiently close patterns are eliminated, and the information functions which are different from each other are stored in the second database (152).

Accordingly, a frame ($X_j(t)$) (310) in the time domain can be expressed with the energy function ($e_j(t)$), frame gain factor ($C_j$), and information function ($S_j(t)$) as follows:

$$X_j(t)=C_j*e_j(t)*S_j(t);j=1,2,3, \ldots ,m$$

The third database (153) comprises the difference, that is to say the noise, between the original states of the speech signals (300) and their reconstructed state after they are represented with functions. The frames (310) of each sample speech signal (300) represented as X(t)=C*e(t)*s(t) are reconstructed using these functions thereby obtaining reconstructed frames. The reconstructed frames (X(t)) are subtracted from the original frames (310) thereby obtaining the noise (noise(t)) as follows.

$$\text{Noise}(t)=Y(t)-X(t)$$

The third database (153) includes these noise functions. Similar to the first database (151) and the second database (152); the noises having similar patterns or the same patterns can be eliminated thereby allowing for patterns that are different from each other.

The database (150) is provided in the first device (100) as well as in the second device (200) by means of its copy. When a speech signal (300) is desired to be sent simultaneously, the indexes of the functions that represent the frames (310) of the speech signal (300) are transmitted sequentially. As mentioned before, this substantially reduces the bandwidth that is used, while enabling the speech files to occupy less space at the time of recording since only the indexes will be recorded during recording. The quality of hearing is substantially increased by means of the noise function which is another innovative part of the invention.

The index referred to herein defines a unique identification number assigned to the function and an address specifying its position in the database with which the function is associated.

Referring to FIG. 1, the first device (100) further includes a first input/output unit (130). The first input/output unit (130) enables the first device (100) to receive speech input and/or transmit speech output. The first input/output unit (130) may comprise a microphone and may include electronic components for converting the signal received from the microphone to the appropriate format. The first input/output unit (130) may also comprise a loudspeaker.

The first device (100) comprises a first processing unit (110). The first processing unit (110) may be a microprocessor. The first processing unit (110) may also be connected to a first memory unit (140). The first processing unit (110) can store data in the first memory unit (140) permanently or temporarily. The first memory unit (140) may be configured to store data permanently or temporarily (RAM, ROM, etc.). The first processing unit (110) can access the first database (151), the second database (152), and the third database (153).

The first device (100) further comprises a first communication interface (120). The first communication interface (120) enables the first device (100) to send and receive data to/from the second device (200). The first communication interface (120) is arranged so as to communicate in TCP/IP protocol in this exemplary embodiment.

The second device (200) further includes a second input/output unit (230). The second input/output unit (230) enables the second device (200) to transmit speech input and/or receive speech output. The second input/output unit (230) may have an audio output, particularly a loudspeaker, in order to produce voice. The second input/output unit (230) may also comprise a microphone.

The second device (200) comprises a second processing unit (210). The second processing unit (210) may be a microprocessor. The second processing unit (210) may also be connected to a second memory unit (240). The second processing unit (210) can store data in the second memory unit (240) permanently or temporarily. The second memory unit (240) may be configured to store data permanently or temporarily. The second processing unit (210) can access the first copy database (251), the second copy database (252), and the third copy database (253).

The second device (200) also includes a second communication interface (220). The second communication interface (220) enables the second device (200) to send and receive data to/from the first device (100). The second communication interface (220) is arranged so as to communicate in TCP/IP protocol in this exemplary embodiment.

The first device (100) and the second device (200) can be a smart phone, computer, server, tablet computer, etc.

The example operation of the system, which is described above in detail and wherein real time speech is transferred from the first device (100) to the second device (200), is as follows: The first device (100) receives a speech signal (300) by means of the first input/output unit (130) as the input. It divides the said speech signal (300) into frames by collecting samples in a predetermined frequency. For example, it selects an energy function from the first database (151) for the first frame. When selecting the energy function, it selects the one having the closest energy pattern to the energy pattern of the first frame. It selects information function for the first frame from the second database (152). It performs information function selection by selecting the function expressing a pattern most similar to the pattern of the frame.

The noise is computed by subtracting from the first frame the reconstructed frame, which is obtained by the information function, energy function and frame gain factor. The most suitable noise function for the obtained noise is selected from the third database (153). The noise function selection process is carried out by selecting the most suitable energy function and information function to the noise obtained.

The first processing unit (110) identifies the indexes of the selected functions in the databases and sends these indexes to the second device (200) via the first communication interface (120).

The second device (200) receives the indexes via the second communication interface (220), and the second processing unit (210) determines the concerned functions from the copy database (250). With the determined functions (energy function, information function and noise function), it reconstructs the first frame, whose index information is received, and obtains a new frame. The second processing unit (210) allows the new frames to be output from the second input/output unit (230) as a speech output or voice in an appropriate format.

The steps performed for the first frame are carried out for each frame (310) and thus real time speech data transfer is enabled.

The reconstructed frame mentioned here describes the frame represented by using the energy and information functions. The new frame defines a frame obtained by adding noise to the reconstructed frame.

The scope of protection of the present invention is specified in the accompanying claims. It can definitely not be limited to the above detailed description which is provided by way of example. It is obvious that a person skilled in the art can provide similar embodiments in the light of the foregoing description without departing from the spirit of the invention.

REFERENCE NUMBERS IN THE FIGURES

100 First device
110 First processing unit
120 First communication interface
130 First input/output unit
140 First memory unit
150 Database
151 First database
152 Second database
153 Third database
200 Second device
210 Second processing unit
220 Second communication interface
230 Second input/output unit
240 Second memory unit
250 Copy database
251 First copy database
252 Second copy database
253 Third copy database
300 Speech signal
310 Frame

The invention claimed is:

1. A voice communication method for a communication system comprising at least one first device and at least one second device which are linked in a manner that enables data transfer with each other; characterized in that it comprises:

the steps performed by the first device (100), wherein the steps are:

receiving a speech signal as the input:

dividing the said speech signal into frames:

accessing a first database comprising multiple energy functions that are different from each other, each of which represents the energy patterns of the frames of multiple sample speech signals; a second database comprising multiple information functions, each of which represents at least the information signal and/or carrier signal of the frames of multiple sample speech signals; and a third database comprising noise functions, each of which represents the difference between the initial states of the frames of the multiple sample speech signals and their multiple reconstructed states obtained by using at least one information function and at least one energy function pertaining to these frames;

selecting one energy function and one information function for the frames from the said first database and the said second database:

obtaining a reconstructed frame for each frame by using the selected energy function and the information functions and the frame gain factor:

subtracting the associated reconstructed frame from each frame and selecting one noise function from the third database that expresses the obtained difference:

sending the indexes of the energy, information and noise functions selected for each frame and the frame gain factor to the second device;

and the steps performed by the second device (200), wherein the steps are:

receiving the indexes of the energy, information and noise functions related to the frames and the frame gain factor:

accessing one copy of each of the first database, second database and third database, and selecting energy, information and noise functions related to the indexes for each frame:

obtaining a reconstructed frame from the selected energy, information function and frame gain factor;

constructing a new frame by adding the associated noise function to each reconstructed frame.

2. The Voice communication method according to claim 1, characterized in that, following the step of constructing a new frame by adding the associated noise function to each reconstructed frame, it comprises the step of:

constructing a new speech signal by merging sequential new frames.

3. A Voice communication system comprising a first device having a processing unit that exchanges data via a first communication interface, and a second device having a second communication interface arranged to provide data exchange with the said first device, and a second processing unit receiving data from the said communication interface or transmitting data to the communication interface; characterized in that the first processing unit is configured to receive a speech signal as the input; divide the said speech signal into frames; access a first database comprising multiple energy functions that are different from each other, each of which represents the energy patterns of the frames of multiple sample speech signals; a second database comprising multiple information functions, each of which represents at least the information signal and/or carrier signal of the frames of multiple sample speech signals; and a third database comprising noise functions, each of which represents the difference between the initial states of the frames of the multiple sample speech signals and their reconstructed states obtained by using at least one information function and at least one energy function pertaining to these frames; select one energy function and one information function for the frames from the said first database and the said second database, obtain a reconstructed frame for each frame using the selected energy function and the information functions, subtract the associated reconstructed frame from each frame and selecting one noise function from the third database that expresses the obtained difference, send the indexes of the energy, information and noise functions selected for each frame to the second device; and that the second processing unit is configured to receive the indexes of the energy, information and noise functions related to the frames as input; access one copy of each of the first database, second database and third database, and select energy, information and noise functions related to the indexes for each frame; obtain a reconstructed frame from the selected energy and information function; construct a new frame by adding the associated noise function to each reconstructed frame.

4. The Voice communication system according to claim 3, characterized in that the second processing unit is configured to enable the new frames to be provided as voice output through an input/output unit.

* * * * *